United States Patent [19]

Brown

[11] Patent Number: 4,565,403

[45] Date of Patent: Jan. 21, 1986

[54] MARKSMAN'S COLLAPSIBLE, PORTABLE, SHOOTING BENCH AND TABLE ASSEMBLY

[76] Inventor: Robert R. Brown, 18865 Oak Tree Ave., Oregon City, Oreg. 97045

[21] Appl. No.: 579,309

[22] Filed: Feb. 13, 1984

[51] Int. Cl.[4] ..... A47B 83/02; A47B 3/14

[52] U.S. Cl. ..... 297/3; 42/94; 89/37.04; 108/38; 297/135; 297/170; 297/174; 312/235 R

[58] Field of Search ..... 108/34, 38, 93; 297/1, 297/2, 3, 174, 170, 135, 139, 144, 440; 312/235 A, 235 R; 42/94; 89/37.04, 37 BA

[56] References Cited

U.S. PATENT DOCUMENTS

| | | | |
|---|---|---|---|
| D. 165,273 | 11/1951 | Dunlap | 312/235 R X |
| 1,018,593 | 2/1912 | Swanson | 108/93 |
| 1,590,586 | 6/1926 | McDonald | 312/235 R X |
| 1,712,213 | 5/1929 | Janicke | 297/135 X |
| 2,564,338 | 8/1951 | McCarroll | 297/2 X |
| 2,754,890 | 7/1956 | Rubin | 312/235 R X |
| 3,125,929 | 3/1964 | Peasley | 297/135 X |
| 3,592,506 | 7/1971 | Breslow | 297/1 X |
| 3,617,104 | 11/1971 | Stadig | 312/235 R X |
| 3,711,984 | 1/1973 | Dyer et al. | 42/94 |
| 3,765,719 | 10/1973 | Silver | 297/170 |
| 4,296,963 | 10/1981 | Blanchard et al. | 297/170 |

FOREIGN PATENT DOCUMENTS

| | | | |
|---|---|---|---|
| 1149740 | 12/1957 | France | 297/139 |
| 262757 | 10/1949 | Switzerland | 297/139 |

*Primary Examiner*—William E. Lyddane
*Assistant Examiner*—Thomas A. Rendos
*Attorney, Agent, or Firm*—Eugene D. Farley

[57] ABSTRACT

A marksman's collapsible, portable, shooting bench and table assembly. The assembly comprises a bench open on its underside to provide a storage compartment and shiftable between an upright, use position and an inverted, storage position. A chest is contoured and dimensioned for nesting in the compartment. A foldable table top folds about the chest in the nesting position of the latter. A collapsible leg assembly is dimensioned for storage in the compartment. Fastening means releasably fasten the table top in its opened out use position to the leg assembly in its extended use position. Attaching means releasably attach the bench in an upright, use position to selected ones of the legs of the leg assembly in their extended use position.

8 Claims, 5 Drawing Figures

MARKSMAN'S COLLAPSIBLE, PORTABLE, SHOOTING BENCH AND TABLE ASSEMBLY

BACKGROUND AND GENERAL STATEMENT OF THE INVENTION

This invention relates to collapsible, portable bench and table assemblies. It pertains particularly to collapsible, portable bench and table assemblies, commonly called "shooting benches", of the class used by marksmen when target shooting with firearms.

Shooting benches are employed in the field, often on rough, soft and uneven terrain, and in various locations. For their successful application, it is important that the benches be readily portable so that they can be transported from place to place. It is further important that the bench assmeblies be easily assembled into packages of small compass which may be set up and taken down rapidly and quickly in each target shooting location.

It also is important that the bench assemblies have a high degree of stability, thereby promoting accurate shooting.

It accordingly is the general purpose of the present invention to provide a bench and table assembly, particularly a shooting bench and table assembly, which is readily portable, which may be rapidly and quickly assembled and disassembled, and which when assembled is steady and stable.

Further objects and purposes of the present invention are the provision of such an assembly which is readily adjustable to suit terrain of uneven contour, which will accommodate shooters of varying height and shooting habits, which is applicable equally to use by users of rifles and hand guns, which has a high storage capacity for guns and other paraphernalia, which is stable and sturdy in use, even under rough conditions, and which collapses and folds into a trunk-like unit which is self contained and easily transportable, without loose parts to be transported separately and subject to loss.

The foregoing and other objects of the present invention are accomplished by the provision of a collapsible, portable bench and table assembly including broadly a bench, a chest, a foldable table top, a collapsible table leg assembly, fastening means for releasably fastening the table top to the leg assembly, and attaching means for attaching the bench to selected ones of the legs of the leg assembly.

The bench is provided with legs on each end, is open on its underside to provide a storage compartment, and is shiftable between an upright, use position and an inverted, storage position.

The chest is contoured and dimensioned for nesting in the compartment between the bench legs.

The foldable table top is adjustable between an opened out use position and a folded storage position wherein it encloses the chest when the chest is nested in the compartment.

The collapsible leg assembly is adjustable between an extended use position and a collapsed storage position wherein the leg assembly is insertable in the bench compartment for storage.

Fastening means releasably fasten the table top in its opened-out, use position to the leg assembly in its extended, use position. Attaching means releasably attach the bench in its upright use position to selected ones of the legs of the leg assembly in its extended use position. A bench and table assembly thus is provided which is stable and sturdy in its extended use position, but which may be collapsed readily to a compact, trunk-like assembly well adapted for storage and transportation from place to place.

THE DRAWINGS

DESCRIPTION OF A PREFERRED EMBODIMENT OF THE INVENTION

As indicated above, the shooting bench and table assembly of my invention comprises a seat or bench component 10, a chest component 12, a foldable table top component 14 and a collapsible leg assembly 16. These components are indicated generally in FIG. 2.

Figure 2:
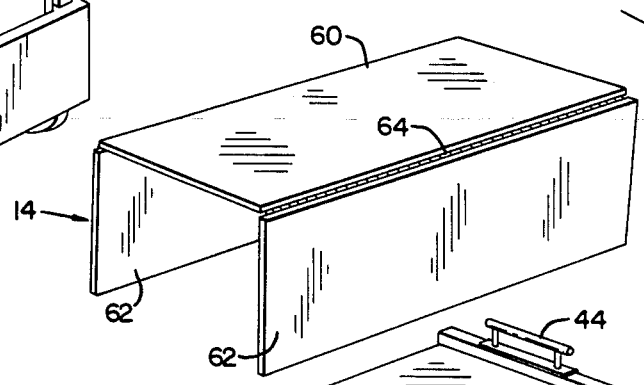
FIG. 2 is an exploded top perspective view of the assembly of FIG. 1.
Figure 2:
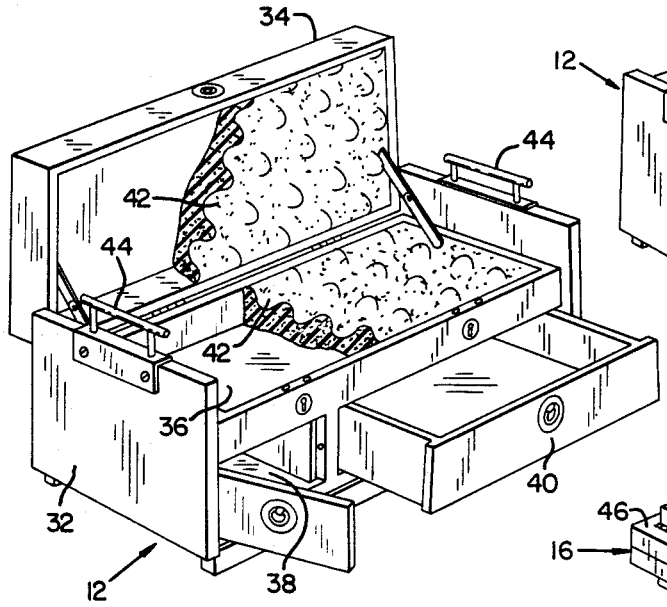
Figure 2:
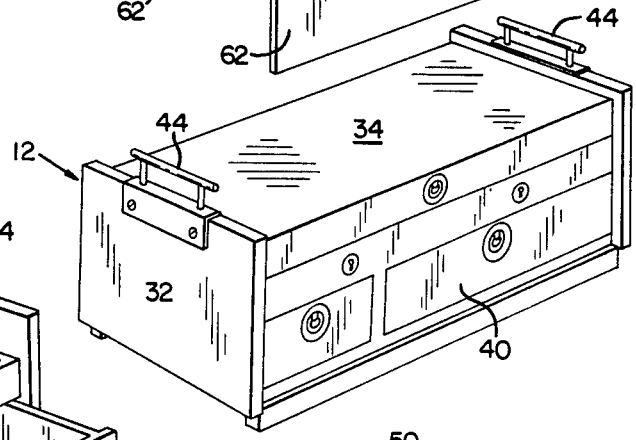
Figure 2:
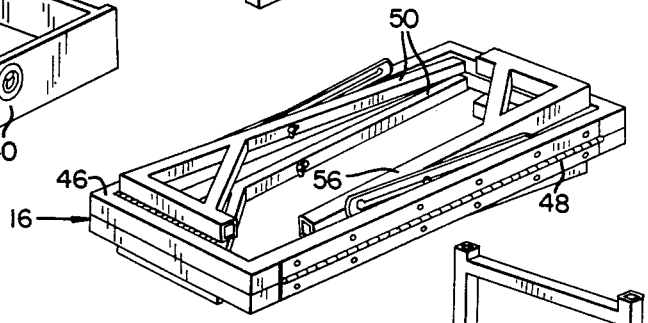
Figure 4:
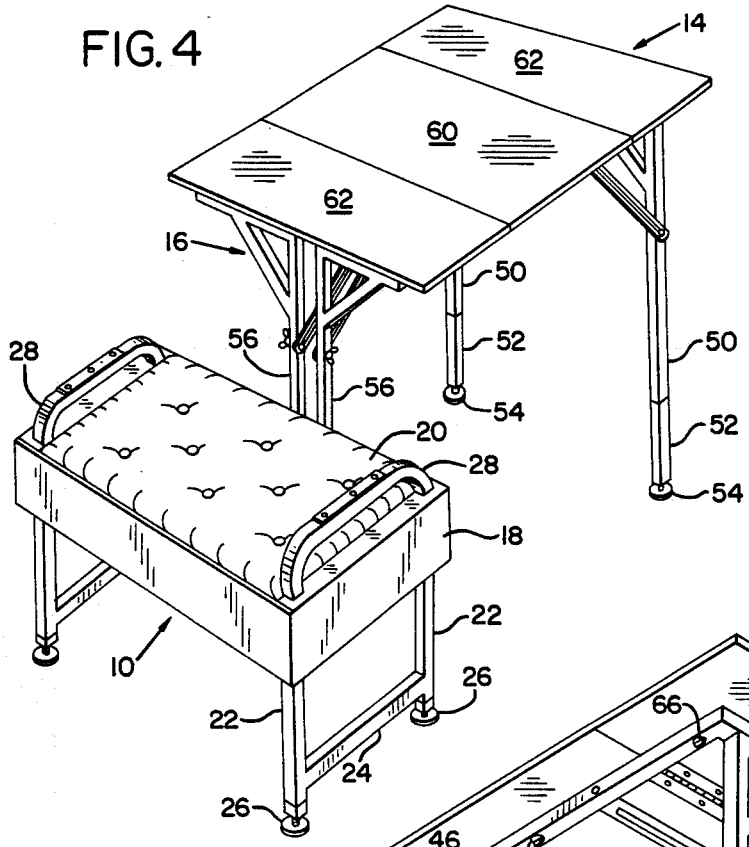
FIG. 4 is a top perspective view and FIG. 5 is an enlarged bottom perspective view of the bench and table components of the herein described assembly in their opened out condition.

Seat or bench component 10 comprises a seat frame 18 with its top preferably covered with upholstery 20, FIGS. 2 and 4. The frame is open on its underside to provide a storage compartment to which access is afforded when the bench is in its inverted or upended position.

The bench is generally rectangular in outline. Its underside mounts legs 22 at the corners and the legs at each end of the bench are interconnected by cross pieces 24. In the upright FIG. 4 position, the legs support the bench. In the upended FIG. 2 position of the bench, cross pieces 24 provide handles by means of which the finished assembly may be carried.

Swiveling pads or feet 26, one on each leg, permit accommodation of the bench to irregular terrain.

One side member of bench frame 18 is provided with bolt holes 30. These provide means for releasably attaching the bench component to the table component of the assembly, as will appear hereinafter.

Figure 3:
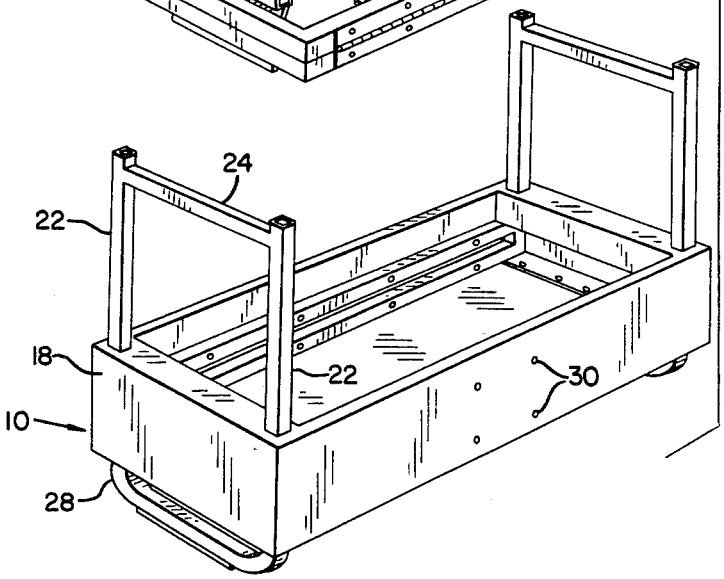
FIG. 3 is a detail perspective view, partly in section, of a chest component of the assembly of FIG. 1, in its open condition.

Chest 12, FIGS. 2 and 3, is contoured and dimensioned to nest in the compartment provided by the open underside of bench 10, when the latter is in its inverted position. Its purpose is to provide storage for firearms and accessories, or other paraphernalia to be used in connection with the application of the bench assembly.

Although the chest may be variously designed, in the illustrated embodiment it comprises a rectangular box 32, having a hinged cover 34.

The chest is compartmented by providing an upper tray 36, a compartment 38, and a sliding drawer 40.

Cover 34 and tray 36 are provided with foamed plastic pads 42 which cushion the contents, for example, hand guns placed in the tray which may be kept, when desired, in a locked condition.

Handles 44 are attached to the upper end edges of box 32 to render the box readily portable.

The table components of the assembly comprises a collapsible leg sub-assembly 16 and folding top 14. As illustrated in FIG. 2, the collapsible leg assembly, when in collapsed condition, is designed to be received in the compartment provided by bench 10. It may be stored there, beneath chest 12.

Figure 5:
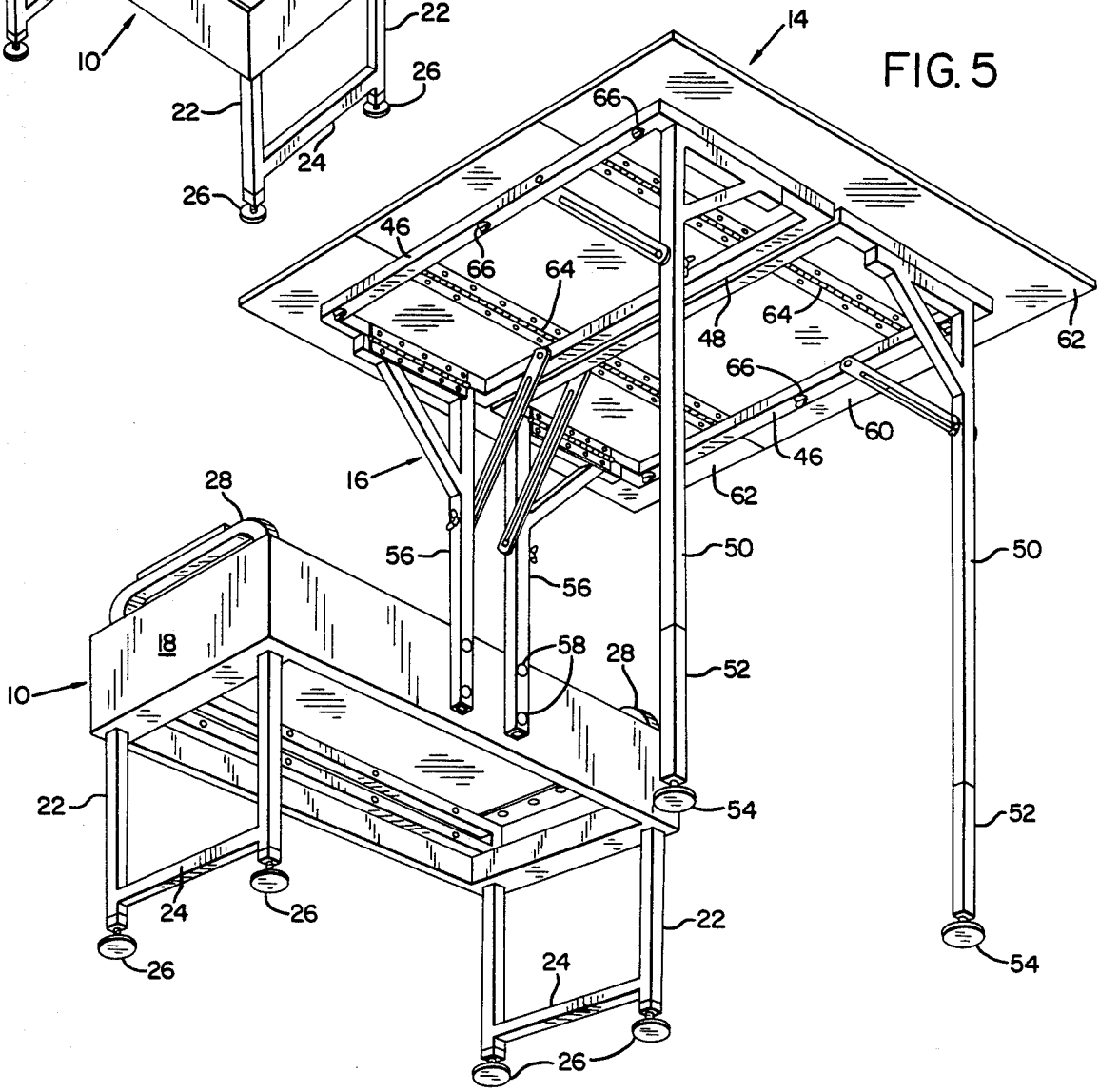

As shown particularly in FIG. 5, the collapsible table leg sub-assembly comprises a pair of rectangular base members 46 hinged together by means of piano hinge 48.

The frame thus provided supports a pair of braced, folding, outer legs 50. These mount in telescoping relation extension pieces 52 and swiveling feet or pads 54. The leg extensions permit use of the assembly on uneven or sloping terrain.

Frame members 46 also mount inner folding, braced legs 56. Whereas outer legs 50 are placed at the corners of the frame, inner legs 56 are placed centrally thereof where they may be straddled by the bench user. Also, inner legs 56 may be relatively short, since they are supported by bench 10, thereby integrating the benchtable assembly. This is accomplished by means of releasable bolts or thumb screws 58 which penetrate openings in legs 56 registering with openings 30 in the side frame member of bench 10.

Table top assembly 14 preferably comprises a center section 60 to which two side sections 62 are hinged by means of piano hinges 64, FIG. 2. Central section 60 and side section 62 are dimensioned in such a manner that when the table top is in the folded condition of FIG. 2, it may be slipped over the top of chest 12, where it is received frictionally and gravitationally between the end and side pieces in the manner indicated. It thus provides an envelope or cover for the assembly in its collapsed condition. If desired, it may be held in position by means of suitable fasteners, not illustrated.

OPERATION

Figure 1:
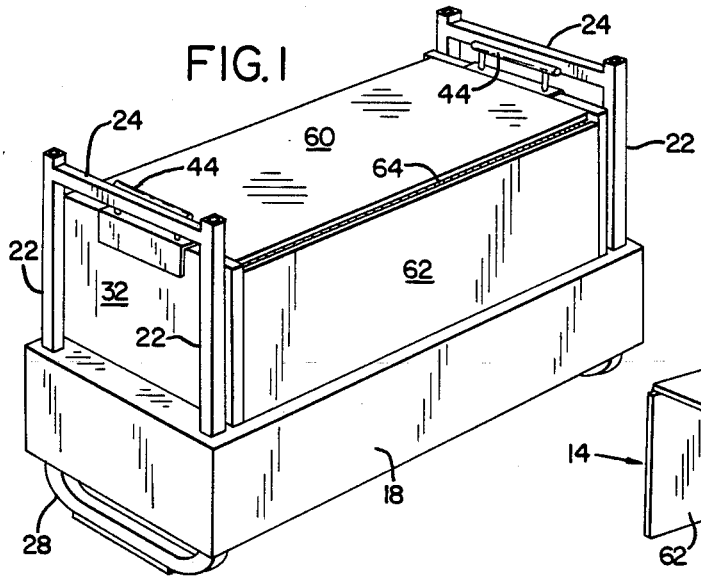
FIG. 1 is a top perspective view of the collapsible, portable bench and table assembly of my invention in its storage condition.

The portable, collapsible shooting bench of my invention is used as follows:

During transportation and storage the assembly appears as illustrated in FIG. 1. In this condition it rests on rails 28. It may be carried from place to place using handles 24.

When it is desired to use the assembly, the components are separated as illustrated in FIG. 2. Leg subassembly 16 is unfolded, as is table top 14. Bench 10 is rotated from its inverted position of FIGS. 1 and 2 to its upright position of FIGS. 4 and 5. The bench may be moved about by using rails 28 as handles. Short, central legs 56 of the table leg subassembly are bolted to the side of bench frame 18, as shown in FIG. 5. The resulting integrated assembly thus is supported on bench legs 22 and extendable table legs 50.

The assembly is completed by unfolding table top 14 and bolting it to the upper side of leg frame 46, by means of bolts 66. Chest 12 then may be stationed near the erected benchtable assembly, open, with its contents available for use.

After the use of the shooting bench has been completed it may be collapsed and returned to its storage and transport position by reversing the sequence of operation outlined above.

Having thus described my invention in preferred embodiments, I claim:

1. A collapsible, portable, bench assembly comprising:

(a) a bench provided with legs on each end extending downward from the underside thereof, said underside being open to provide a storage compartment between said legs, the bench being shiftable between an upright, use position and an inverted storage position, (b) a chest contoured and dimensioned for nesting in the compartment between the bench legs, (c) a foldable table top adjustable between an opened out use position, and a folded, storage position, wherein it encloses the chest when the chest is nested in the compartment, (d) a collapsible leg assembly adjustable between an extended use position and a collapsed storage position wherein the leg assembly is insertable in the bench compartment for storage, (e) fastening means releasably fastening the table top in its opened out use position to the leg assembly in extended use position, and (f) attaching means releasably attaching the bench in its upright use position to selected ones of the legs of the leg assembly in its extended use position.

2. The assembly of claim 1 wherein there is a pair of legs on each of opposite ends of the bench and including a cross piece interconnecting the ends of each pair, the cross pieces being positioned for use as handles for the assembly when the bench is in its inverted storage position.

3. The assembly of claim 1 including a pair of rails, one on each of opposite sides of the bench, and serving as spacers for spacing the bench vertically from a supporting surface when the bench is in its inverted storage position.

4. The assembly of claim 3 wherein the rails are contoured as handles for use in handling the bench when it is in its upright use position.

5. The assembly of claim 1 wherein the assembly is a shooting bench and table assembly, and wherein the chest includes a plurality of compartments for containing and storing guns and related paraphernalia.

6. The assembly of claim 1 wherein the chest is rectangular in cross section and the table top comprises three sections hinged together and dimensioned to fold around three sides of the chest when the chest is nested in the compartment.

7. The assembly of claim 1 wherein the leg assembly comprises a frame adapted to be fastened by the fastening means to the table top and comprising two sections hinged together for folding, and a plurality of folding legs attached to and depending from the frame.

8. The assembly of claim 7 wherein there are four legs arranged in two pairs, one pair being remote from the bench and the other pair being adjacent the bench, the pair adjacent the bench being adapted for attachment thereto by the attaching means.

* * * * *